US005291843A

United States Patent [19]

Hori

[11] Patent Number: 5,291,843

[45] Date of Patent: Mar. 8, 1994

[54] ATTACHMENT STRUCTURE FOR DETACHABLY ATTACHING WORKPIECE HOLDER TO MOVABLE BODY

[75] Inventor: Masayuki Hori, Gifu, Japan

[73] Assignee: Brother Kogyo Kabushikia Kaisha, Nagoya, Japan

[21] Appl. No.: 848,150

[22] Filed: Mar. 9, 1992

[30] Foreign Application Priority Data

Mar. 22, 1991 [JP] Japan ..... 3-17429[U]

[51] Int. Cl.[5] ..... D05C 9/04

[52] U.S. Cl. ..... 112/103; 112/121.15; 38/102.2; 403/329

[58] Field of Search ..... 112/103, 121.12, 121.15, 112/262.3, 266.1, 102; 38/102.2, 102; 269/99, 100; 223/DIG. 2; 403/326, 321, 329

[56] References Cited

U.S. PATENT DOCUMENTS 4,763,586 8/1988 Takenoya et al. ..... 112/103

5,101,746 4/1992 Frye ..... 112/121.12

FOREIGN PATENT DOCUMENTS 62-122890 8/1987 Japan .

63-81890 5/1988 Japan .

0888574 1/1962 United Kingdom ..... 112/103

*Primary Examiner*—Peter Nerbun

*Attorney, Agent, or Firm*—Oliff & Berridge

[57] ABSTRACT

An attachment structure for detachably attaching a workpiece holder to a movable body used in embroidery stitching in a sewing machine. The movable body is movable in a horizontal plane in synchronism with a reciprocating motion of a sewing needle in order to move the workpiece relative to the needle. The workpiece is supported on the workpiece holder held by the movable body. The attachment structure includes pair of pins disposed at one of the workpiece holder and the movable body, pair of engaging grooves engageable with the pins and formed at remaining one of the movable body and the workpiece holder, projecting body disposed at one of the workpiece holder and the movable body, and resilient member engageable with the projecting body and disposed at remaining one of the movable body and the workpiece holder.

18 Claims, 6 Drawing Sheets

ATTACHMENT STRUCTURE FOR DETACHABLY ATTACHING WORKPIECE HOLDER TO MOVABLE BODY

BACKGROUND OF THE INVENTION

The present invention relates to an attachment structure for detachably attaching a workpiece holder to a movable body which is relatively movable with respect to a sewing needle.

A workpiece holder is used for holding a workpiece such as a fabric for embroidery stitching by a sewing machine, and conventionally, the holder is detachably held by a movable body. For example, a Japanese Utility Model Application Kokai(OPI) No. 62-122890 discloses an attachment structure for detachably attaching the workpiece holder. As shown in prior art FIG. 1 of the present application, a pair of guide pins 51*a*, 51*b* are implanted in a movable body 53 which is movable in synchronism with reciprocating motion of a sewing machine (not shown). The movable body 53 has a stepped portion where a pair of slots 53*a*, 53*b* are formed. Further a leaf spring 65 is fixed to the movable body 53.

A workpiece holder 59 for holding a fabric includes an inner frame 55 and an outer frame 57 to which one end portion of an attachment piece 63 is provided. The attachment piece 63 has an intermediate portion whose end face serves as engaging planes 61*a*, 61*b* engageable with the pair of guide pins 51*a*, 51*b*. Further, the attachment piece 63 has another end portion provided with pair of projections 63*a*, 63*b*.

For attaching the workpiece holder 59 to the movable body 53, the two projections 63*a*, 63*b* are inserted through the pair of slots 53*a*, 53*b* of the movable body 53 in a direction indicated by an arrow A, while the attachment piece 63 is slantingly oriented such that the vertical position of the projections 63*a*, 63*b* is lower than that of the holder 59. Therefore, the projections 63*a*, 63*b* are brought into engagement with the leaf spring 65 with the latter being resiliently deformed. Then, the attachment piece 63 is urged to be depressed downwardly. Accordingly, the engaging planes 61*a*, 61*b* are brought into engagement with the associating guide pins 51*a*, 51*b*. Thus, the attachment piece 63 is held by the movable body 53 through the leaf spring 65, to thereby fix the workpiece holder 59 to the movable body 53 in parallelism with a stitching plane.

Further, a Japanese Utility Model Application Kokai (OPI) No. 63-81890 also discloses an attachment structure. As shown in prior art FIG. 2 of the present application, a movable body 73 movable in synchronism with the reciprocating motion of a sewing needle is fixed with a pair of positioning pins 71*a*, 71*b*. A generally U-shaped leaf spring 75 is provided whose lower end portion is fixedly secured to a lower face of the movable body 73 and at a position below the positioning pin 71*b*. An upper end portion of the leaf spring 75 is formed with an elongated notch 75*a* and is directed toward the pin 71*b*, so that the pin 71*b* is positioned in an elongated notch 75*a*.

A workpiece holder 81 has an inner frame 77 and an outer frame 79 to which one end of an angled link arm 83 is fixedly secured. At one side end face of the link arm 83, a positioning notch 85 is formed which is engageable with the positioning pin 71*a*. Further, the angled link arm 83 is formed with a positioning hole 87 engageable with the positioning pin 71*b*. The leaf spring 75 is adapted for preventing the positioning pins 71*a*, 71*b* from being disengaged from the positioning notch 85 and the positioning hole 87, respectively.

For attaching the workpiece holder 81 to the movable body 73, the positioning notch 85 is brought into engagement with the positioning pin 71*a* as shown by two dotted chain line in FIG. 2, and the workpiece holder 81 is angularly rotated about the pin 71*a* in a counterclockwise direction in FIG. 2. During this angular motion, the link arm 83 is urgedly interposed, against the biasing force of the leaf spring 75, between the upper portion of the leaf spring 75 and an upper surface of the movable body 73. Next, the link arm 83 is lifted upwardly further against the biasing force of the leaf spring 75 in order to place the link arm 83 on the positioning pin 71*b*. At the same time, the link arm 83 is pressed toward the movable body 73 so as to provide engagement of the positioning pin 71*b* with the positioning hole 87. The engagements of the pins 71*a*, 71*b* with the notch 85 and the hole 87 can be maintained by virtue of the leaf spring 75. Thus, the workpiece holder 81 can be fixed to the movable body 73.

According to the conventional arrangement, as described in JP 62-122890 and as shown in prior art FIG. 1 of the present application, the workpiece holder 59 must be positioned between a sewing needle and a throat plate while preventing the holder 59 from abutting the sewing needle. Then, the two projections 63*a*, 63*b* must be engaged with the leaf spring 65 while avoiding mechanical interference between the engaging planes 61*a*, 61*b* and the guide pins 51*a*, 51*b*, and thereafter, the holder 59 is angularly rotated in the vertical direction for providing the engagement between the engaging planes and the guide pins, while still obviating mechanical interference between the sewing needle and the workpiece holder 59. Therefore, such angular movement may require skill and thus, the attachment and detachment work of the workpiece holder may be troublesome for an operator.

The same is true with respect to the other conventional arrangement described in JP 63-81890. This arrangement also requires angular rotational movement of the workpiece holder 81 within a limited narrow space defined between the sewing needle and the throat plate for the attachment and detachment work.

SUMMARY OF THE INVENTION

It is therefore, an object of the present invention to overcome the above-described drawbacks and to provide an improved attachment structure for facilitating detachment and attachment work of a workpiece holder with respect to a movable body.

This and other objects of the invention will be attained by providing an attachment structure for detachably attaching a workpiece holder to a movable body, the movable body being movable in a horizontal plane in synchronism with a reciprocating motion of a sewing needle in a sewing machine, the attachment structure comprising first and second walls, at least one engaging pin, a projecting member, and a resilient member. The first wall extends in a vertical direction and is provided at one of the workpiece holder and movable body. The first wall is formed with at least one engaging groove having U-shape configuration. The second wall extends in a vertical direction and is provided at remaining one of the movable body and the workpiece holder. The at least one engaging pin extends from the second wall.

The at least one engaging pin is engageable with the at least one engaging groove in relative vertical sliding movement between the first and the second walls for preventing the workpiece holder from being moved in the horizontal plane. The projecting member is provided at one of the first and the second walls. The resilient member is provided at remaining one of the second and the first walls. The resilient member has a guide portion engageable with the projecting member for preventing the workpiece holder from being moved in the vertical direction.

BRIEF DESCRIPTION OF THE DRAWINGS

In the drawings;

FIG. 6(*b*) is a side elevational view showing a state in which the workpiece holder is completely attached to the movable body according to the first embodiment of this invention;

DETAILED DESCRIPTION OF THE PREFERRED EMBODIMENTS

Figure 1:
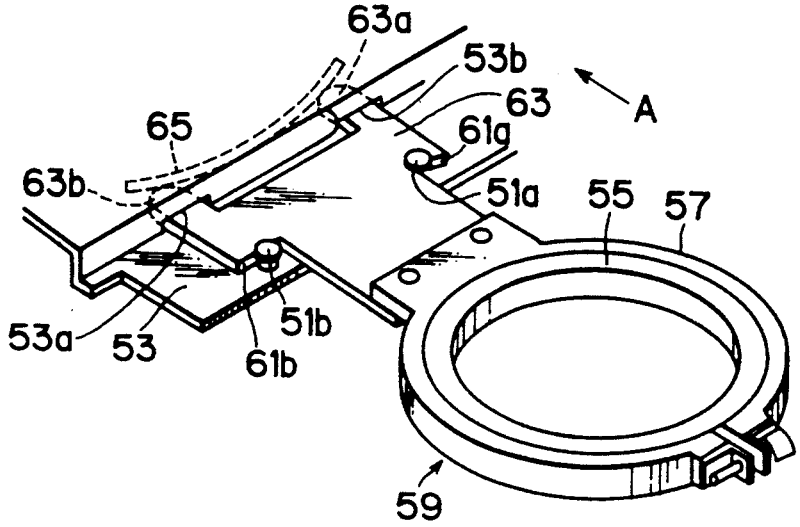
FIG. 1 PRIOR ART
FIG. 1 is a perspective view showing an attachment structure for detachably attaching a workpiece holder to a movable body in a sewing machine according to one example of a conventional arrangement.
Figure 2:
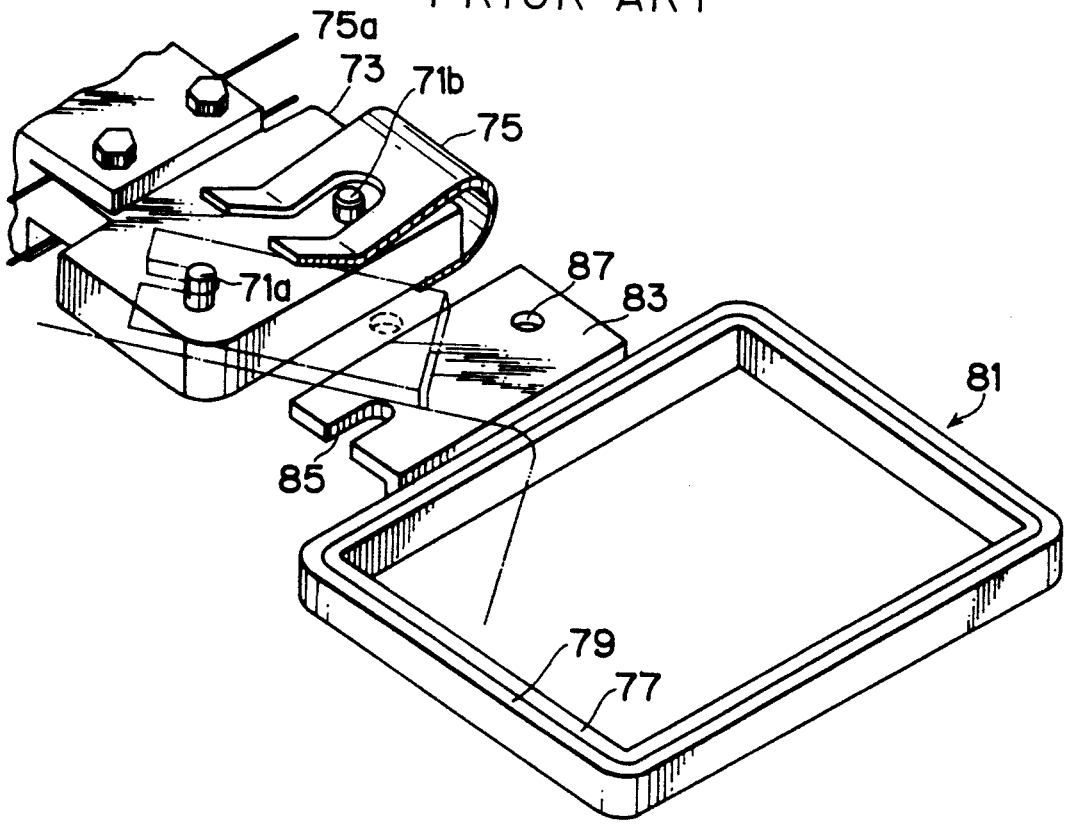
FIG. 2 PRIOR ART
FIG. 2 is a perspective view showing an attachment structure for detachably attaching a workpiece holder to a movable body in a sewing machine according to another example of a conventional arrangement.
Figure 3:
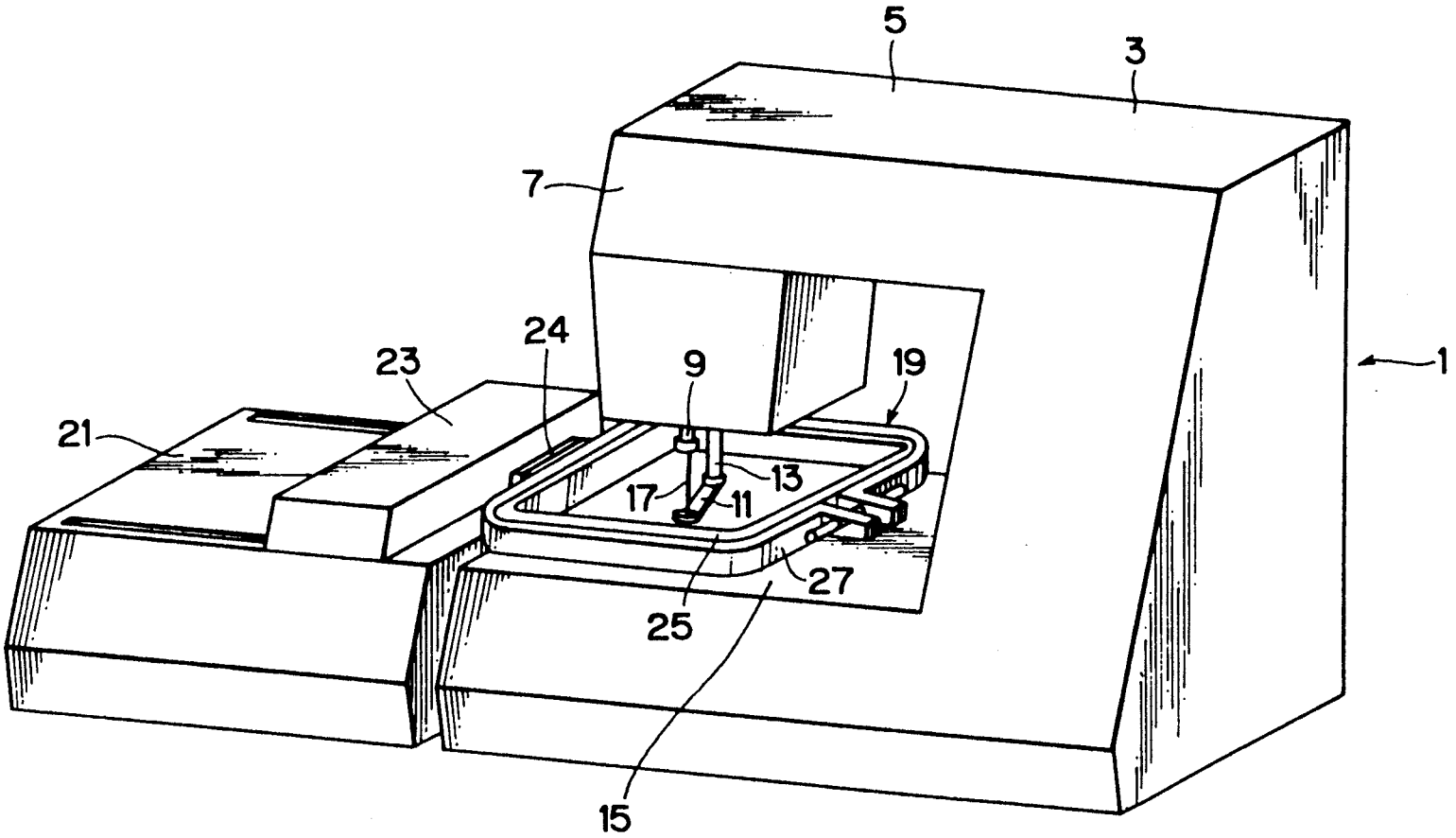
FIG. 3 is a schematic perspective view showing a sewing machine having a movable body and a workpiece holder attached thereto.

An attachment structure for detachably attaching a workpiece holder to a movable body according to a first embodiment of the present invention will be described with reference to FIGS. 3 through 6(*b*). First, general arrangement of an embroidery sewing machine 1 will be described with reference to FIG. 3. The sewing machine 1 has a machine frame 3 including an upper arm 5 and a head 7. The head 7 supports a needle bar 9 movable in vertical and horizontal directions for supporting a sewing needle 17. The head 7 also supports a pressure bar 13 whose lower end is provided with a pressure foot 11 for pressing a workpiece such as a fabric (not shown). A bed 15 is provided for supporting the workpiece fabric, and a throat plate (not shown) formed with a needle hole (not shown) is provided at the bed 15 at a position immediately below the needle bar 9 and the pressure bar 13. At a position below the bed 15, a conventional feed dog mechanism (not shown) is accommodated. The feed dog is movable in the vertical direction through an operation member (not shown) for feeding the workpiece fabric suited for straight stitching or zig-zag stitching.

An embroidery unit 21 is disposed adjacent the sewing machine 1, and a movable body 23 is mounted on the embroidery unit 21. The movable body 23 is movable in X and Y directions in a horizontal plane. The movable body 23 is provided with a holder attaching unit 24 to which a workpiece holder 19 is detachably attached. The workpiece holder 19 includes an inner frame 25 and an outer frame 27 those formed of a synthetic resin for holding the workpiece fabric therebetween. Thus, the embroidery unit 21 moves the workpiece holder 19 with respect to the sewing needle 17 in the X and Y directions through the holder attaching unit 24. Incidentally, the embroidery unit 21 has a drive mechanism for moving the movable body 23, the drive mechanism being conventional in this art as described in Japanese Utility Model Application Kokai (OPI) No. 63-81890.

Figure 4:
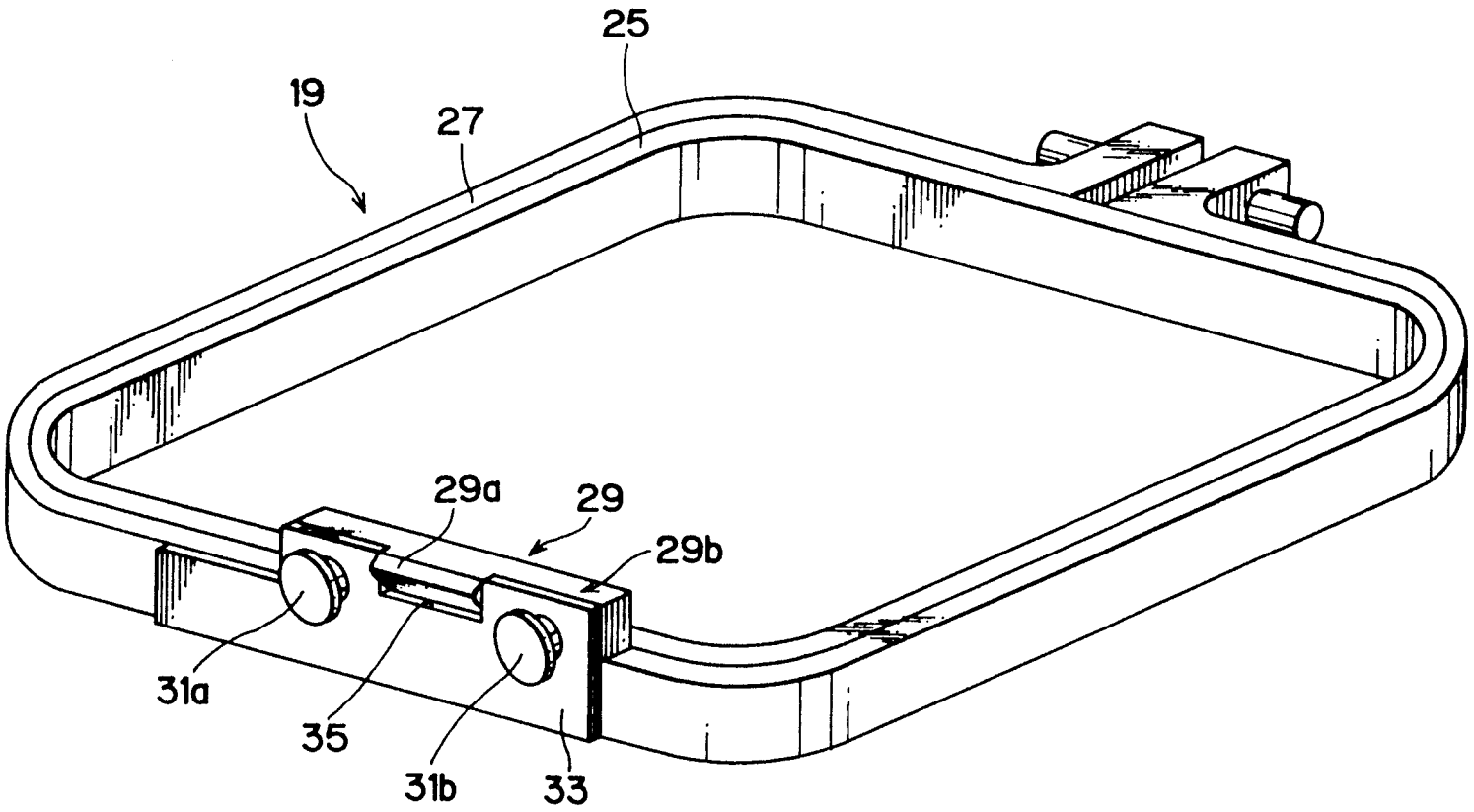
FIG. 4 is a perspective view showing a workpiece holder according to a first embodiment of this invention.

Next, the workpiece holder 19 is best shown in FIG. 4. The outer frame 27 of the workpiece holder 19 has one side to which a projecting segment 29 is integrally provided. The projecting segment 29 includes a rectangular block 29*b* extending along the one side and projecting upwardly from an upper end face of the outer frame 27. Further, the projecting segment 29 includes a projecting body 29*b* provided integrally with the rectangular block 29*b* and having a triangular cross section whose apex is directed outwardly (toward the attaching unit 24 when assembling). An outer plate member 33 is fixed by a belleville spring (not shown) to an outer side face of the one side of the outer frame 27 and at a position adjacent the projecting segment 29. A pair of engagement pins 31*a*, 31*b* extend outwardly in a horizontal direction from the outer plate member 33. Further, the outer plate member 33 is formed with an upper U-shaped notch 35 at a position between the engagement pins 31*a* and 31*b* so as to allow the projecting body 29*b* to protrude therethrough outwardly (toward the attaching unit 24 when assembling).

Figure 5:
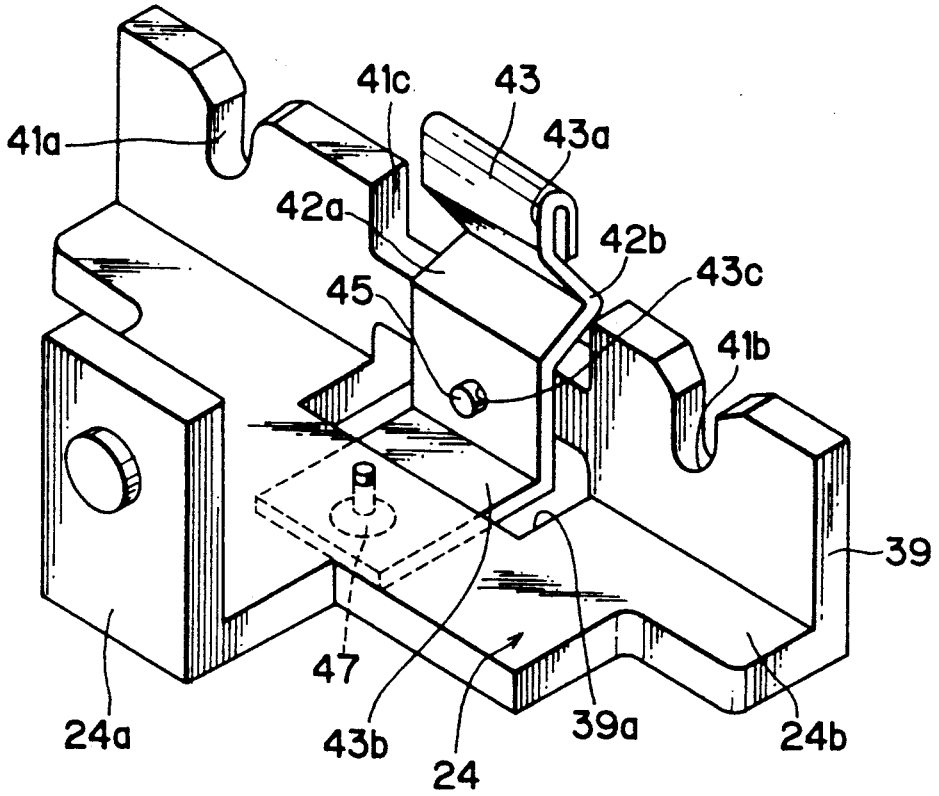
FIG. 5 is a perspective view showing a movable body according to the first embodiment of this invention to which the workpiece holder shown in FIG. 4 is to be attached.

The attaching unit 24 is best shown in FIG. 5. The unit 24 includes a first vertical wall 24*a* for fixing the unit 24 to the movable body 23, a horizontal wall 24*b* and a second vertical wall 39 positioned remote from the movable body 23 when assembling and extending parallel with the first vertical wall 24*a*. The second vertical wall 39 is to be faced with the outer plate member 33 when assembling. The second vertical wall 39 is formed with a pair of upper U-shaped grooves 41*a* and 41*b* at positions alignable with the pair of engagement pins 31*a*, 31*b* so as to provide engagement therebetween. Further, the second vertical wall 39 is formed with an upper U-shaped notch 41*c* at a position between the U-shaped grooves 41*a* and 41*b*, and a resilient segment 43 is placed at the central U-shaped notch 41*c*. A positioning pin 45 inwardly extends from one or inner face of the second vertical wall 39 at a position below the U-shaped notch 41*c*. At a boundary between the second vertical wall 39 and the horizontal wall 24*b*, an opening 39*a* is formed.

The resilient segment 43 has a vertical section 43*a* and a horizontal section 43*b*. The vertical section 43*a* is formed with a hole 43*c* slidingly engageable with the positioning pin 45. Thus, the resilient segment 43 is supported to one or inner side face of the second vertical wall 39 through the positioning pin 45. As a result, the positioning pin 45 prevents the vertical section 43*a* from moving in a vertical direction but allows the vertical section 43a to slidingly move in the horizontal direction with respect to the pin 45. Further, the vertical section has a bent portion 42a having a V-shape in side view. A top edge 42b of the bent portion 42a extends outwardly from the one side face of the second vertical wall and is positioned in the central U-shaped notch 41c. The bent portion 42a serves as a guide for guiding movement of the projecting body 29a.

On the other hand, a boundary portion between the vertical and horizontal sections 43a and 43b is positioned within the opening 39a, and the horizontal section 43b is positioned below the horizontal wall 24b and is fixed thereto by means of a screw 47. Thus, the resilient segment 43 is fixedly secured to the attaching unit 24.

Figure 6A:
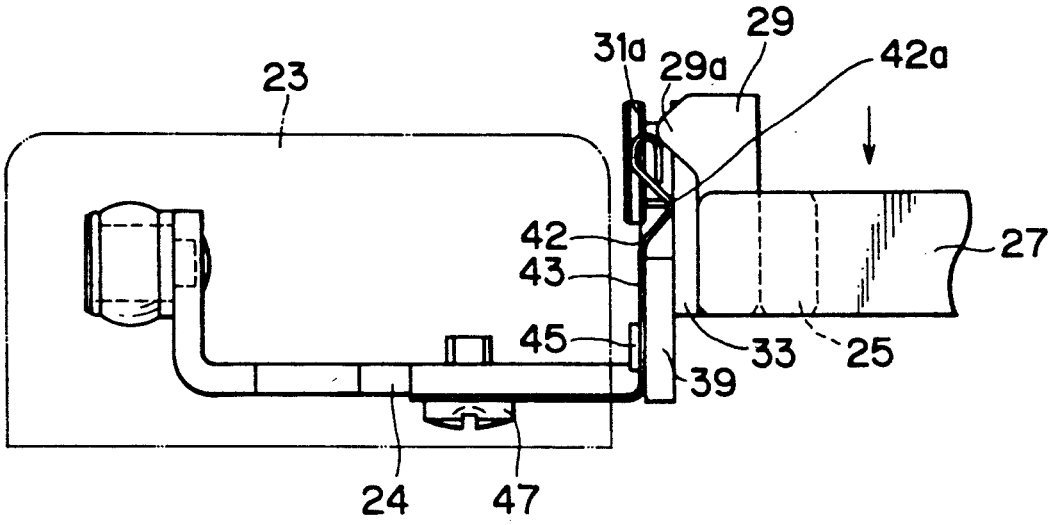
FIG. 6(*a*) is a side elevational view showing the workpiece holder prior to complete attachment to the movable body according to the first embodiment of this invention.
Figure 6B:
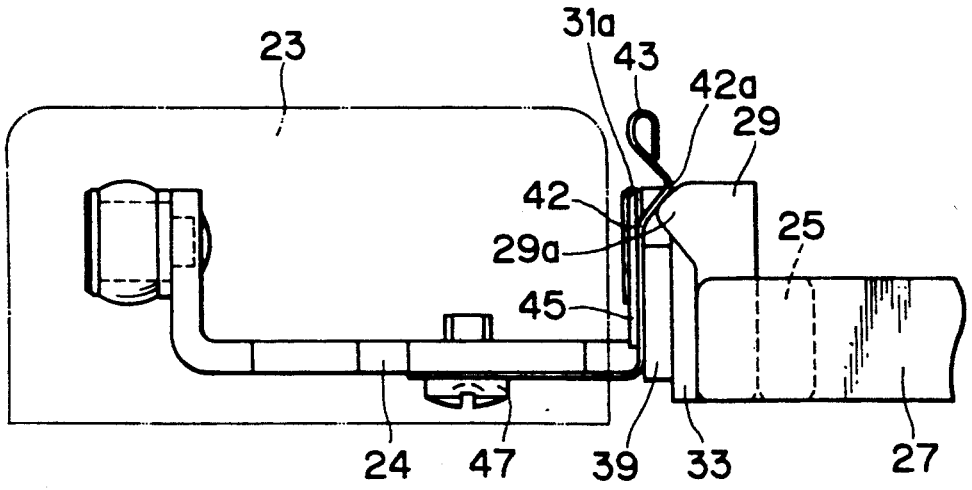

In order to attach the workpiece holder 19 to the holder attaching unit 24, the pair of engaging pins 31a, 31b of the outer plate member 33 is brought into alignment with the upper edges of the pair of U shaped grooves 41a, 41b of the second vertical wall 39 of the attaching unit 24. In this case, the projecting body 29 is positioned above the bent portion 42a as best shown in FIG. 6(*a*). Then, the workpiece holder 19 is entirely depressed downwardly while maintaining horizontally extending posture thereof. Accordingly, the pair of engaging pins 31a, 31b are brought into engagement with the pair of U-shaped grooves 41a, 41b.

During this downward movement of the workpiece holder 19, the projecting body 29 abuts the vertical section 43a, and the vertical section 43a is resiliently moved or deformed to a direction away from the second vertical wall 39. If the apex edge 29a of the projecting body 29 is moved past the top end 42b of the bent portion 42a, the vertical section 43a can gradually restore its original shape, and the bent portion 42a serves as a guide member for guiding further downward movement of the projecting body 29 because of the resiliency of the resilient member 43 as shown in FIG. 6(*b*). Thus, the engaging pins 31a and 31b are urged to bottom of the U-shaped grooves 41a, 41b by the resilient member 43, to thereby ensure tight securing of the workpiece holder 19 to the attaching unit 24. Accordingly, horizontal orientation of the workpiece holder 19 at a given location can be provided with respect to a stitch working surface on the bed 15.

Reversely, detachment work of the workpiece holder 19 from the holder attaching unit 24 can be made by simply lifting the holder 19 against the biasing force of the resilient member 43. In this case, upward movement of the projecting body 29 causes the large deformation of the resilient member 43 to a direction away from the second vertical wall 39 when the apex end of the projecting body 29 is brought into abutment with the bent portion 42a. Thus, the workpiece holder 19 becomes disengaged from the resilient member 43 for detaching the holder from the attaching unit 24.

Figure 7:
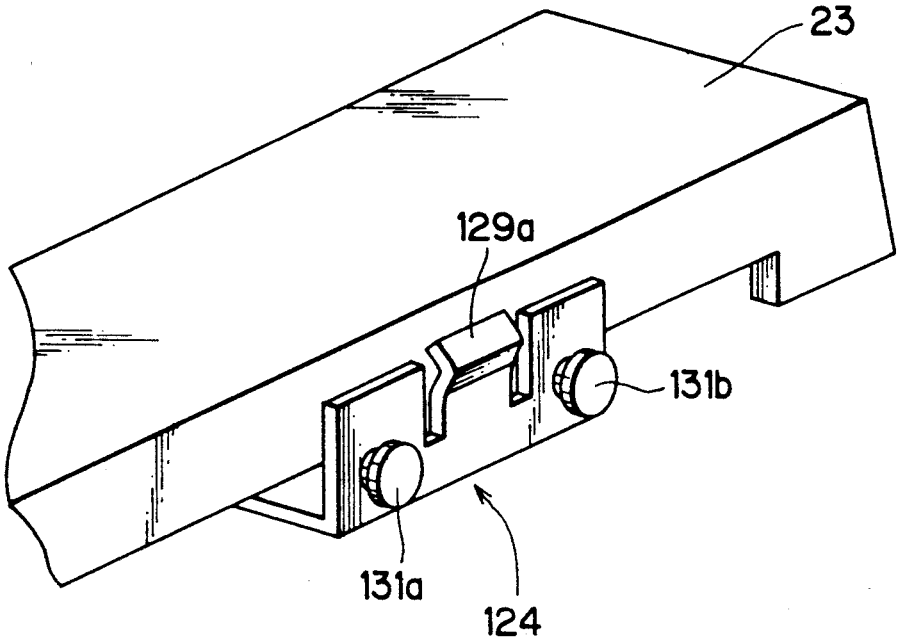
FIG. 7 is a perspective view showing a movable body according to a second embodiment of this invention.
Figure 8:
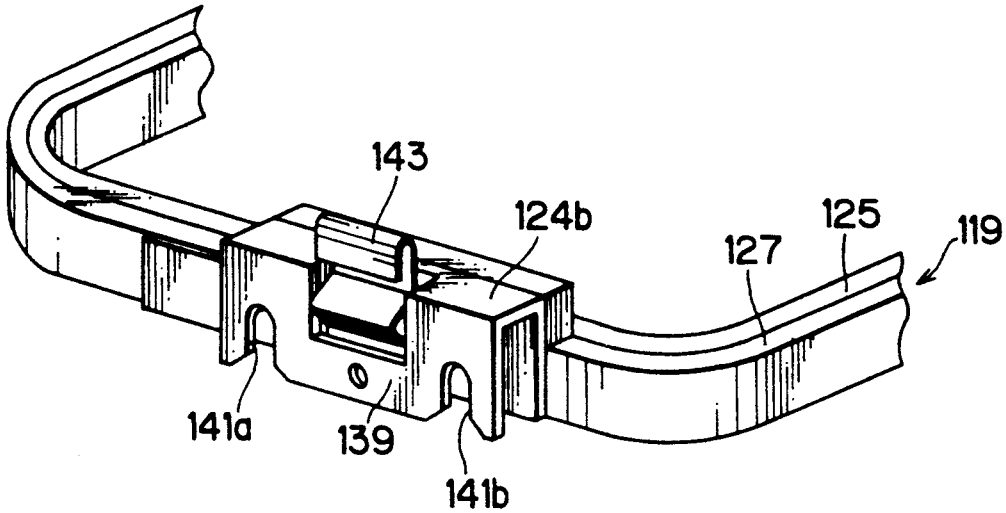
FIG. 8 is a perspective view showing a workpiece holder according to the second embodiment of this invention.

An attachment structure for detachably attaching a workpiece holder to a movable body according to a second embodiment of the present invention will be described with reference to FIGS. 7 and 8. According to the second embodiment, a workpiece holder 119 having an inner and outer frames 125, 127 is provided with an outer vertical section 139 in which a pair of engagement grooves 141a and 141b (corresponding to the grooves 41a and 41b of the first embodiment) are formed. Further, a resilient member 143 (corresponding to the resilient member 43 in the first embodiment) is provided at the workpiece holder 119. Further, a pair of engaging pins 131a, 131b (corresponding to the pins 31a, 31b in the first embodiment) and a projecting body 129a (corresponding to the projecting body 29a of the first embodiment) are provided at the movable body 23 to serve as a attaching unit 124. Thus, the second embodiment can provide the similar operation to that in the first embodiment.

In any event, in the present invention, the resilient member is provided at one of the workpiece holder and the attaching unit, and associating projecting body is provided at remaining one of the attaching unit and the workpiece holder. Similarly, the engaging pins are provided at one of the workpiece holder and the attaching unit and associating engaging grooves are formed at remaining one of the attaching unit and the workpiece holder. Other components for supporting these components are also disposed to one of the workpiece holder and the attaching unit in accordance with the disposals of the pins, the grooves, the resilient member and the projecting body. Further, in the first embodiment, the projecting body 29a is projected outwardly through the rectangular notch 35 of the outer plate member 33. However, as a modification, the projecting body can be provided integral with the outer plate member. In the latter case, it is unnecessary to form the rectangular notch at the outer plate member 33.

Thus, in the present invention, the attachment and detachment work for the workpiece holder with respect to the movable body can be made through two dimensional movement of the holder avoiding angular rotational movement thereof. Therefore, attachment-/detachment work can be facilitated without particular attention to the mechanical abutment between the workpiece holder and the sewing needle.

While the invention has been described in detail and with reference to specific embodiment thereof, it would be apparent to those skilled in the art that various changes and modifications may be made therein without departing from the spirit and scope of the invention.

What is claimed is:

1. An attachment structure in combination with a workpiece holder and a movable body for detachably attaching the workpiece holder to the movable body, the movable body being movable in a horizontal plane in synchronism with a reciprocating motion of a sewing needle in a sewing machine, the attachment structure comprising;

a first wall extending in a vertical direction and provided at one of the workpiece holder and the movable body, the first wall being formed with at least one engaging groove having U-shaped configuration;

a second wall extending in a vertical direction and provided at a remaining one of the movable body and the workpiece holder;

at least one engaging pin extending from the second wall, the at least one engaging pin being engageable with the at least one engaging groove in relative vertical sliding movement between the first and the second walls for preventing the workpiece holder from being moved in the horizontal plane;

a projecting member provided at one of the first and the second walls; and a resilient member provided at the remaining one of the second and the first walls, the resilient member having a guide portion engageable with the projecting member for preventing the workpiece holder from being moved in the vertical direction.

2. The attachment structure as claimed in claim 1, wherein the workpiece holder comprises a rectangular outer frame and a rectangular inner frame engageable with the outer frame for holding the workpiece therebetween, and wherein the second wall comprises an outer plate member fixed to one outer side of the outer frame member, the outer plate member being formed with an upper U-shaped notch (35) through which a part of the projecting member extends, the U-shaped notch being positioned between a pair of engagement pins.

3. The attachment structure as claimed in claim 2, wherein the first wall is supported on the movable body and comprises:

a first vertical section fixed to the movable body;

a horizontal section integral with the first vertical section;

a second vertical section integral with the horizontal section and extending in parallel with the first vertical section, the second vertical section being faced with the outer plate member and being formed with a pair of engaging grooves at an upper portion thereof for engagement with the pair of engaging pins, the second vertical section being also formed with a U-shaped notch at a position between the pair of engaging grooves.

4. The attachment structure as claimed in claim 3, wherein the resilient member has a horizontal part fixed on the horizontal section and has a vertical part movable toward and away from the second vertical section, the guide portion being positioned in the vertical part and positioned in the U-shaped notch of the second vertical section.

5. The attachment structure as claimed in claim 4, wherein the projecting member has a triangular cross-section, and wherein the guide portion has a triangular shape engageable with the triangular projecting member.

6. The attachment structure as claimed in claim 1, wherein the second wall is supported to the movable body, and a pair of engaging pins extends from the second wall, the projecting member being provided integrally with the second wall.

7. The attachment structure as claimed in claim 6, wherein the workpiece holder comprises a rectangular outer frame and a rectangular inner frame engageable with the outer frame for holding the workpiece therebetween, and wherein the first wall comprises:

a first vertical section fixed to an outer side of the outer frame;

a horizontal section integral with the first vertical section;

a second vertical section integral with the horizontal section and extending in parallel with the first vertical section, the second vertical section being faced with the second wall and being formed with a pair of engaging grooves at a lower portion thereof for engagement with the pair of engaging pins, the second vertical section being also formed with a U-shaped notch at a position between the pair of engaging grooves.

8. The attachment structure as claimed in claim 7, wherein the resilient member is supported on the second vertical section, and the guide portion is positioned in the U-shaped notch of the second vertical section.

9. The attachment structure as claimed in claim 8, wherein the projecting member has a triangular shape and wherein the guide portion has a triangular shape engageable with the triangular projecting member.

10. An attachment structure for detachably attaching a workpiece holder to a movable body, the movable body being movable in a horizontal plane in synchronism with a reciprocating motion of a sewing needle in a sewing machine, the attachment structure extending between the workpiece holder and the movable body and comprising;

a first wall extending in a vertical direction and being formed with at least one engaging groove having a U-shaped configuration;

a second wall facing the first wall and extending in a vertical direction;

at least one engaging pin extending from the second wall, the at least one engaging pin being engageable with the at least one engaging groove in relative vertical sliding movement between the first and the second walls for preventing the workpiece holder from being moved in the horizontal plane;

a projecting member provided at one of the first and the second walls; and a resilient member provided at a remaining one of the second and the first walls, the resilient member having a guide portion engageable with the projecting member for preventing the workpiece holder from being moved in the vertical direction.

11. The attachment structure as claimed in claim 10, wherein the second wall comprises an outer plate member fixable to the workpiece holder, the outer plate member being formed with an upper U-shaped notch through which a part of the projecting member extends, the U-shaped notch being positioned between a pair of engagement pins.

12. The attachment structure as claimed in claim 11, wherein the first wall comprises:

a first vertical section fixable on the movable body;

a horizontal section integral with the first vertical section;

a second vertical section integral with the horizontal section and extending in parallel with the first vertical section, the second vertical section being faced with the outer plate member and being formed with a pair of engaging grooves at an upper portion thereof for engagement with the pair of engaging pins, the second vertical section being formed with a U-shaped notch at a position between the pair of engaging grooves.

13. The attachment structure as claimed in claim 12, wherein the resilient member has a horizontal part fixed to the horizontal section and has a vertical part movable toward and away from the second vertical section, the guide portion being positioned in the vertical part and positioned in the U-shaped notch of the second vertical section.

14. The attachment structure as claimed in claim 13, wherein the projecting member has a triangular cross-section, and wherein the guide portion has a triangular shape engageable with the triangular projecting member.

15. The attachment structure as claimed in claim 10, wherein the second wall if fixable on the movable body and a pair of engaging pins extends from the second wall, the projecting member being provided integrally with the second wall.

16. The attachment structure as claimed in claim 15, wherein the first wall comprises:

a first vertical section fixable to the workpiece holder;

a horizontal section integral with the first vertical section;

a second vertical section integral with the horizontal section and extending in parallel with first vertical section, the second vertical section being faced with the second wall and being formed with a pair of engaging grooves at a lower portion thereof for engagement with the pair of engaging pins, the second vertical section being formed with a U-shaped notch at a position between the pair of engaging grooves.

17. The attachment structure as claimed in claim 16, wherein the resilient member is supported on the second vertical section, and the guide portion is positioned in the U-shaped notch of the second vertical section.

18. The attachment structure as claimed in claim 17, wherein the projecting member has a triangular shape and wherein the guide portion has a triangular shape engageable with the triangular projecting member.

* * * * *